US006016415A

United States Patent [19]

Herrick et al.

[11] Patent Number: 6,016,415

[45] Date of Patent: Jan. 18, 2000

[54] IMAGE TRANSFER APPARATUS AND METHOD USING A SEAMED ENDLESS BELT

[75] Inventors: Diane M. Herrick, Rochester; Thomas N. Tombs, Brockport; Frank L. Ziegelmuller, Penfield, all of N.Y.

[73] Assignee: Eastman Kodak Company, Rochester, N.Y.

[21] Appl. No.: 09/199,896

[22] Filed: Nov. 25, 1998

[51] Int. Cl.[7] ..... G03G 15/00

[52] U.S. Cl. ..... 399/162

[58] Field of Search ..... 399/302, 303, 399/308, 313, 162, 299

[56] References Cited

U.S. PATENT DOCUMENTS

| | | |
|---|---|---|
| 4,078,929 | 3/1978 | Gundlach . |
| 5,190,608 | 3/1993 | Darcy et al. . |
| 5,455,136 | 10/1995 | Yu et al. . |
| 5,487,707 | 1/1996 | Sharf et al. . |
| 5,489,972 | 2/1996 | Shuster et al. . |
| 5,514,436 | 5/1996 | Schlueter, Jr. et al. . |
| 5,549,999 | 8/1996 | Swain et al. . |
| 5,582,949 | 12/1996 | Bigelow et al. . |
| 5,655,205 | 8/1997 | Ziegelmuller et al. . |
| 5,714,290 | 2/1998 | Yu et al. . |

OTHER PUBLICATIONS

PCT Publication WO 98/04961 published Feb. 5, 1998 "The Reproduction of Colour" by R.W.G. Hunt, 5th edition, 1995, pp. 603–611.

*Primary Examiner*—Arthur T. Grimley
*Assistant Examiner*—Greg Moldafsky
*Attorney, Agent, or Firm*—Norman Rüshefsky

[57] ABSTRACT

A reproduction apparatus and method including a toner image bearing member (TIBM) and a seamed endless belt that is brought into transfer relationship with the TIBM at a transfer station by movement of the TIBM in a process direction through the transfer station whereby a marking particle image formed on the TIBM is transferred from the TIBM towards the belt. The seam on the belt is configured in a configuration other than a straight line perpendicular to the process direction and is used in at least some transfers. In one embodiment, the belt is a paper transport belt and a receiver member is supported on the belt so as to overlie the seam on the belt during such transfers. In a second embodiment, the belt serves as an intermediate transfer member (ITM) and at least some transfers are made from the TIBM to the ITM at the seam area of the belt.

34 Claims, 5 Drawing Sheets

IMAGE TRANSFER APPARATUS AND METHOD USING A SEAMED ENDLESS BELT

FIELD OF THE INVENTION

The present invention relates in general to reproduction apparatus and methods wherein a marking particle image is transferred from a toner image bearing member to another member. More particularly, the invention relates to apparatus and methods wherein an endless web is provided for supporting a receiver member during transfer of a toner image to the receiver member which may be a paper or plastic sheet upon which the image is to be fixed. Alternatively, the endless web may be in the form of an intermediate transfer member.

BACKGROUND OF THE INVENTION

In modern high speed/high quality electrostatographic reproduction apparatus (copier/duplicators or printers), a latent image charge pattern is formed on a uniformly charged dielectric support member or primary image-forming member (PIFM). Pigmented marking particles are attracted to the latent image charge pattern to develop such image on the support as a toner image. The dielectric support is then brought into contact with a receiver member and an electric field applied to transfer the marking particle developed toner image to the receiver member from the dielectric support. After transfer, the receiver member bearing the transferred toner image is transported away from the dielectric support and the toner image is fixed to the receiver member by heat and/or pressure to form a permanent reproduction thereon. The receiver member is a paper or plastic transparency sheet upon which the image is to be fixed.

An alternate approach is to use an intermediate transfer member (ITM) and to transfer the toner image formed on the PIFM to the ITM and then to the receiver member. Thus, immediately before transfer of a toner image to a receiver member the toner image may either be on a PIFM or an ITM, either of which is a toner image bearing member (TIBM).

In order to transfer the toner image on the TIBM to the receiver member it is known to transport the receiver member through a transfer nip using a paper transport web. During transfer both the receiver member and the paper transport web are disposed in an electric field to urge transfer of the toner particles on the TIBM to the receiver member.

Heretofore, the paper transport web might be either a seamless belt or a belt with a seam. Seamed belts are preferred because for larger belts they are generally less expensive. The seaming technologies commonly used in the manufacturing of paper transport webs are ultrasonically-welded lap joints, adhesive lap joints, and adhesive butt joints. Each of these seams is considered a hindrance to toner transfer because of a capacitive change introduced in the transport web at the seam. A capacitive change due to the increase in thickness of the transport web at the seam, the presence of adhesive with mismatched dielectric properties, or the presence of an air gap, due to the thickness change in the web, trapped between the receiver and the paper transport web influence the electric field at the seam, causing a change in density of toner transferred to the receiver. An observer can easily detect this image artifact. As noted in U.S. Pat. No. 5,487,707, the seam constitutes a nonfunctional area of a belt and "does not participate in belt functionality such as the formation and transfer of a toner or developer image". Thus, it is suggested in this reference that the non-functional part of the belt; i.e. the seam be kept relatively small from about 1 mm to about 3 mm wide. Since the seam is considered in the prior art nonfunctional for transfer purposes the seamless belts are preferred where cost is not an issue. Where the cost of a seamless belt is considerably more than that of a belt formed with a seam, a belt with a seam is used and accommodation is made through timing controls to ensure that the receiver member is not positioned over the seam area. A problem with this is that where multiple color stations are provided for simultaneous transfer of color toner images to plural receiver members productivity can be reduced because a transfer may need to be delayed to avoid feeding of a receiver member over a seam area.

It is therefore an object of the invention to overcome the deficiencies in the prior art and to provide a reproduction apparatus and method characterized by a seamed paper transfer support belt that can be used as if it were seamless.

It is another object of the invention to provide a belt having a seam and used as an ITM and wherein images are periodically formed on the belt and allowance is made for images to be presented over the seamed area of the belt prior to transfer of an image to a receiver member.

SUMMARY OF THE INVENTION

This invention is directed to a reproduction apparatus and method including a toner image bearing member (TIBM) and a seamed endless belt that is brought into transfer relationship with the TIBM at a transfer station by movement of the TIBM in a process direction through the transfer station whereby a marking particle image formed on the TIBM is transferred from the TIBM towards the belt. In accordance with a first aspect of the invention there is provided moving a toner image bearing member (TIBM) having a toner image formed thereon in a process direction through a transfer nip, the toner image being present in the nip for transfer; moving a belt in the process direction while supported in the nip in transfer relation with the TIBM, the belt having a seam that is configured in a configuration other than a straight line perpendicular to the process direction, the seam being present in the nip; and transferring the toner image from the TIBM towards an area of the belt having the seam as the belt and TIBM move through the nip.

In accordance with a second aspect of the invention, there is provided a reproduction method comprising moving a toner image bearing member (TIBM) having a toner image formed thereon in a process direction through a transfer nip, the toner image being present in the nip for transfer; moving a belt in the process direction while supported in the nip in transfer relation with the TIBM, the belt having a seam that is ground to substantially reduce a step in the seam, the seam being present in the nip; and transferring the toner image from the TIBM towards an area of the belt having the seam as the belt and TIBM move through the nip.

In one embodiment the belt is a paper transport belt and a receiver member is supported on the belt so as to overlie the seam on the belt during such transfers. In a second embodiment the belt serves as an ITM and at least some transfers are made from the TIBM to the ITM at the seam area of the belt.

BRIEF DESCRIPTION OF THE DRAWINGS

In the detailed description of the preferred embodiments of the invention presented below, reference is made to the accompanying drawings, in each of which the relative relationship of the various components are illustrated, it being understood that orientation of the apparatus may be modified.

DETAILED DESCRIPTION OF THE PREFERRED EMBODIMENTS

Figure 1:
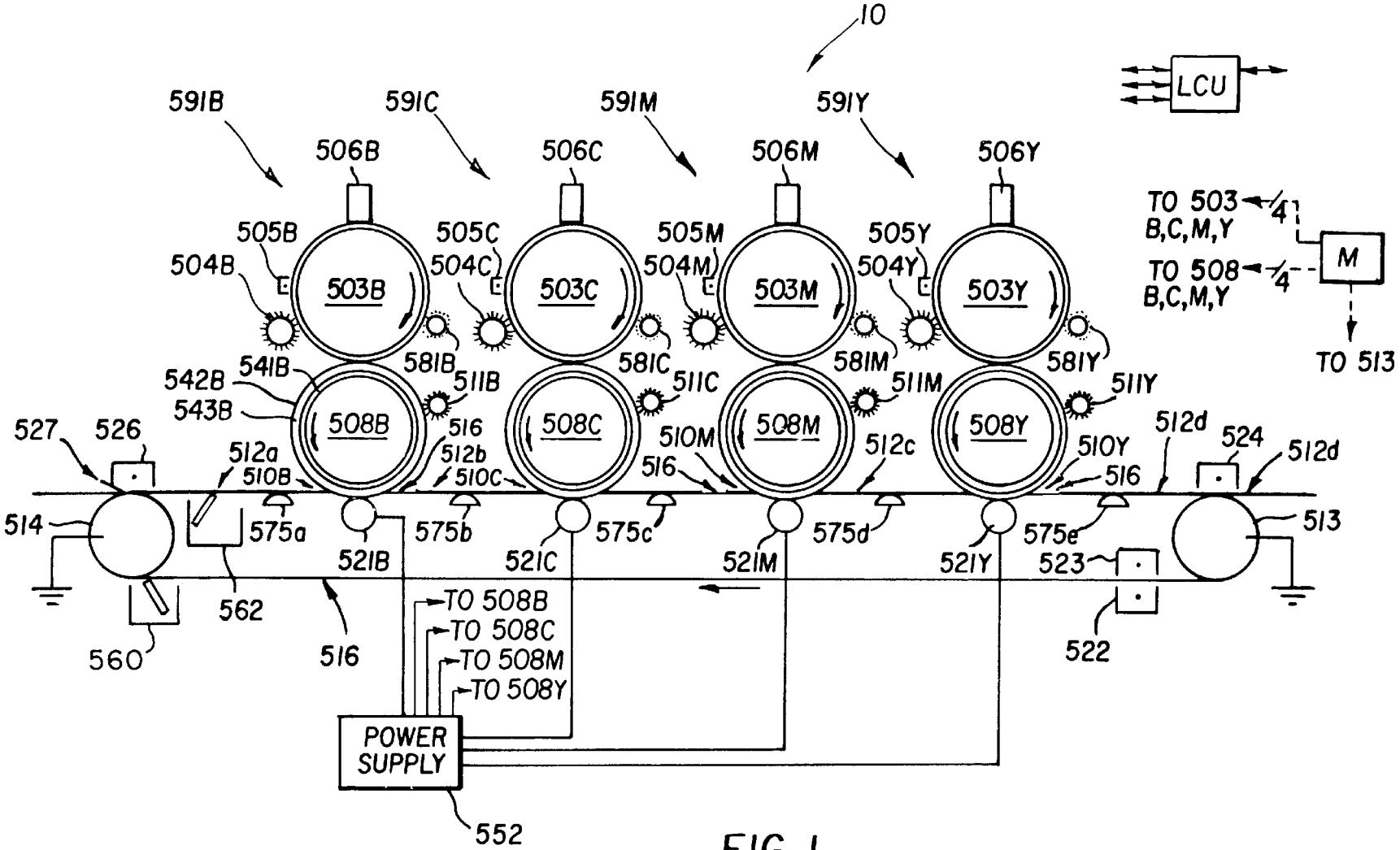
FIG. 1 is a generally schematic side elevational view of a preferred first embodiment of a reproduction apparatus according to the invention.

Referring now to the accompanying drawings, FIG. 1 shows an exemplary image forming reproduction apparatus designated generally by the numeral 10. The reproduction apparatus 10 is in the form of an electrophotographic reproduction apparatus and more particularly a color reproduction apparatus wherein color separation images are formed in each of four colors and transferred in register to a receiver member as a receiver member is moved through the apparatus while supported on a paper transport web 516 that is made in accordance with the invention. The apparatus features four color modules.

Each module (591B, 591C, 591M, 591Y) is of similar construction except that as shown one paper transport belt 516 operates with all the modules and the receiver member is transported by the belt 516 from module to module. The elements in FIG. 1 that are similar from module to module have similar reference numerals with a suffix of B, C, M and Y referring to the color module to which it is associated. Three receiver members or sheets 512*a, b, c* are shown simultaneously receiving images from different respective color modules, it being understood as noted above that each receiver member may receive one color image from each module and that up to four color images can be received by each receiver member. A fourth receiver member 512*d* is shown in a position after being processed through the last color module 591Y. The movement of the receiver member with the belt 516 is such that each color image transferred to the receiver member at the transfer nip of each module is a transfer that is registered with the previous color transfer so that a four-color image formed on the receiver member has the colors in registered superposed relationship on the receiver member. The receiver members are then sent to a fusing station (not shown) to fuse or fix the dry toner images to the receiving member. The belt is reconditioned by providing charge to both surfaces using, for example, opposed corona chargers 522, 523 which neutralize charge on the surfaces of the belt.

Each color module includes a primary image forming member, for example a drum 503B, C, M and Y, respectively. Each drum 503B, C, M and Y has a photoconductive surface, upon which a pigmented marking particle image, or a series of different color marking particle images, is formed. In order to form images, the outer surface of the drum is uniformly charged by a primary charger such as a corona charging device 505 B, C, M and Y, respectively or other suitable charger such as roller chargers, brush chargers, etc. The uniformly charged surface is exposed by suitable exposure means, such as for example a laser 506 B, C, M and Y, respectively or more preferably an LED or other electro-optical exposure device or even an optical exposure device to selectively alter the charge on the surface of the drum to create an electrostatic image corresponding to an image to be reproduced. The electrostatic image is developed by application of pigmented marking particles to the latent image bearing photoconductive drum by a development station 581 B, C, M and Y, respectively. The development station is a particular color of pigmented toner marking particles associated respectively therewith. Thus, module creates a series of different color marking particle images on the respective photoconductive drum. In lieu of a photoconductive drum which is preferred, a photoconductive belt may be used.

Each marking particle image is transferred to an outer surface of a respective secondary or intermediate image transfer member, for example, an intermediate transfer drum 508 B, C, M and Y, respectively. After transfer the toner image is cleaned from the surface of the photoconductive drum by a suitable cleaning device 504 B, C, M and Y, respectively to prepare the surface for reuse for forming subsequent toner images. The intermediate transfer drum or ITM includes a metallic (such as aluminum) conductive core 541 B, C, M and Y, respectively and a compliant blanket layer 543 B, C, M and Y, respectively. The compliant layer is formed of an elastomer such as polyurethane or other materials well noted in the published literature. The elastomer has been doped with sufficient conductive material (such as antistatic particles, ionic conducting materials, or electrically conducting dopants) to have a relatively low resistivity (for example, a bulk or volume electrical resistivity preferably in the range of approximately $10^7$ to $10^{11}$ ohm-cm). Further, the compliant blanket layer is more than 1 mm thick, preferably between 2 mm and 15 mm, and has a Young's Modulus in the range of approximately 0.1 MPa to 10 MPa, and more preferably between 1 MPa and 5 MPa. The blanket layer has a bulk or volume electrical resistivity that is preferably between $10^7$–$10^{11}$ ohm-cm. A thin (2 $\mu$m–30 $\mu$m) hard overcoat layer covers the blanket layer and the overcoat layer has a Young's modulus of preferably greater than 100 MPa. The hard overcoat layer may have a higher bulk or volume electrical resistivity than the blanket layer. With such a relatively conductive intermediate image transfer member drum, transfer of the single color marking particle images to the surface of the ITM can be accomplished with a relatively narrow nip 26 and a relatively modest potential of, for example, 600 volts of suitable polarity applied by a potential source (not shown).

A single color marking particle image respectively formed on the surface 542B (others not identified) of each intermediate image transfer member drum, is transferred to a receiver member, which is fed into a nip between the intermediate image transfer member drum and a transfer backing roller 521B, C, M and Y, respectively that is suitably electrically biased by power supply 552 to induce the charged toner particle image to transfer to a receiver sheet. The receiver member is fed from a suitable receiver member supply (not shown) and moves serially into each of the nips 510B,C, M and Y where it receives the respective marking particle image. The receiver member exits the last nip and is transported by a suitable transport mechanism (not shown) to a fuser where the marking particle image is fixed to the receiver member by application of heat and/or pressure. A detack charger 524 may be provided to deposit a neutralizing charge on the receiver member to facilitate separation of the receiver member from the belt 516. The receiver member with the fixed marking particle image is then transported to a remote location for operator retrieval. The ITM is cleaned by a cleaning device 511B, C, M and Y to prepare it for reuse. Although the ITM is preferred to be a drum, a belt may be used instead as an ITM.

Appropriate sensors (not shown) of any well known type, such as mechanical, electrical, or optical sensors for example, are utilized in the reproduction apparatus 10 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer backing member, and various image processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU including a microprocessor, for example. Based on such signals and a suitable program for the microprocessor, the unit LCU produces signals to control the timing operation of the various electrographic process stations for carrying out the reproduction process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

The receiver members utilized with the reproduction apparatus 10 can vary substantially. For example, they can be thin or thick paper stock or transparency stock. As the thickness and/or resistivity of the receiver member stock varies, the resulting change in impedance affects the electric field used in the nips 510B, C, M, Y to urge transfer of the marking particles to the receiver members. Moreover, variations in relative humidity will vary the conductivity of a paper receiver member, which also causes it to affect the impedance of the transfer field. To overcome these problems, the paper transport belt preferably includes certain characteristics.

The endless paper transport belt 516 is entrained about a plurality of support members. For example, as shown in FIG. 1, the plurality of support members are rollers 513, 514 with preferably 513 being driven as shown by motor M (of course, other support members such as skis or bars would be suitable for use with this invention). The endless belt or web 516 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton™), polyethylene napthoate, or silicone rubber. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 $\mu$m–1000 $\mu$m, preferably, 50 $\mu$m–200 $\mu$m) and is flexible.

In feeding a receiver member onto belt 516 charge may be provided on the receiver member by charger 526 to electrostatically attract the receiver member to the belt 516. A blade 527 associated with the charger 526 may be provided to press the receiver member onto the belt and remove any air entrained between the receiver member and the belt.

A receiver member may be engaged at times in more than one image transfer nip and preferably is not in the fuser nip and an image transfer nip simultaneously. The path of the receiver member for serially receiving in transfer the various different color images is generally straight facilitating use with receiver members of different thicknesses. Support structures 575*a, b, c, d* and *e* are provided before entrance and after exit locations of each transfer nip to engage the belt on the backside and alter the straight line path of the belt to provide for wrap of the belt about each respective ITM so that there is wrap of the belt of greater than 1 mm on each side of the nip or at least one side of the nip and preferably the total wrap is less than 20 mm. This wrap allows for reduced pre-nip and post-nip ionization. The nip is where the pressure roller contacts the backside of the belt or where no pressure roller is used, where the electrical field is substantially applied. However, the image transfer region of the nip is a smaller region than the total wrap. The wrap of the belt about the ITM also provides a path for the lead edge of the receiver member to follow the curvature of the ITM but separate from engagement with the ITM while moving along a line substantially tangential to the surface of the cylindrical ITM. Pressure applied by the pressure rollers 521 B, C, M and Y is upon the backside of the belt 516 and forces the surface of the compliant ITM to conform to the contour of the receiver member during transfer. Preferably, the pressure of the pressure rollers on the belt 516 is 7 pounds per square inch or more. The pressure rollers may be replaced by corona chargers, biased blades or biased brushes. Substantial pressure is provided in the transfer nip to realize the benefits of the compliant intermediate transfer member which are conformation of the toned image to the receiver member and image content on both a microscopic and macroscopic scale. The pressure may be supplied solely by the transfer biasing mechanism or additional pressure applied by another member such as a roller, shoe, blade or brush.

The inventors have found that a perceived reduction in the image artifact can be achieved if the seam is at a 45° angle with respect to the length of the belt. An observer is less sensitive to artifacts that occur at 45° with respect to the horizontal than to artifacts occurring horizontally or vertically in the print. The reason for this phenomenon, as described by R. W. G. Hunt in The Reproduction of Colour, 5th Edition, p. 610, Fountain Press, England (1995), is that the eye and brain system codes vertical and horizontal information preferentially to diagonal information and, therefore, less able to resolve fine detail at 45°. This reduced perception of artifact also motivates the choice for 45° halftone screens.

Further reduction in the artifact can be achieved if the biased seam is made smooth, i.e., by grinding and polishing. Grinding and polishing the seam can reduce its mechanical strength limiting the life of the belt. However, an added benefit associated with forming the seam on a diagonal or on a bias or an angle other that 90° is increased mechanical strength of the endless belt. Forming the seam of the belt at a diagonal with respect to its length or direction of movement allows for a longer interface at which to join the ends of the material. The longer interface allows for a stronger seam.

Figure 2:
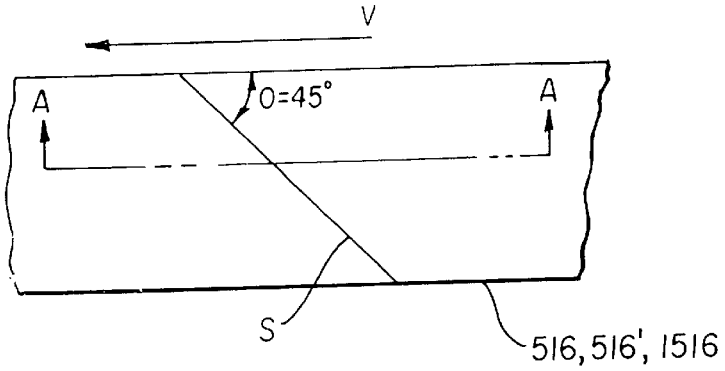
FIG. 2 is a plan view of a portion of a paper transport belt or ITM belt having a seam and used in the apparatus of the invention, the belt is not drawn to scale.
Figure 3:
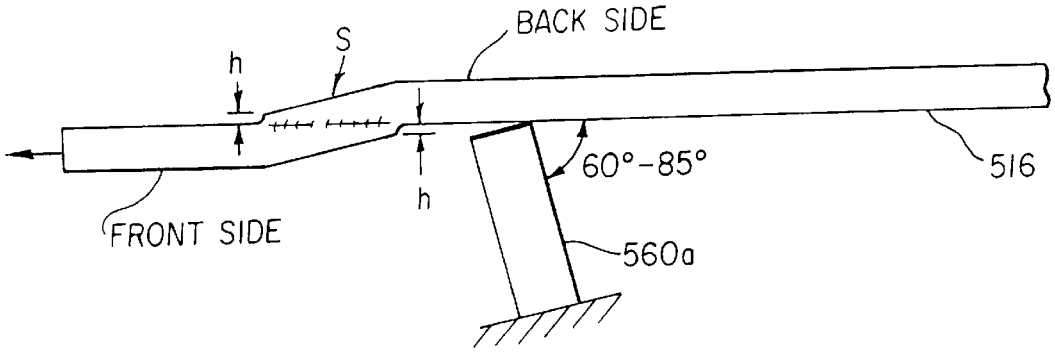
FIG. 3 is an elevational view in cross-section of the seam taken on the line A—A of FIG. 2 and also showing a blade as a front side cleaning device for the belt, the drawing is not to scale.

With reference to FIGS. 2 and 3 which illustrates the portion of the belt 516 in the vicinity of the seam "S", the seam in the belt is at a 45° angle with respect to a lengthwise dimension direction or process direction of movement of the belt shown by arrow V thus reducing the perception of any artifact in a transferred image being associated with the seam. Further finishing of the seam such as grinding improves image quality with increased seam strength when compared to the conventional orientation. A 45° angled seam increases the seam strength by 41% relative to a 90° seam; i.e., one which is perpendicular to the process direction of movement of the belt.

The angle of the seam can range from about 20° to about 60° and is preferably about 45° relative to the lengthwise dimension direction of the belt. The seam is an ultrasonically welded lap joint with an overlap range of 1/16"–1/4" and preferably, 3/16". This amount of overlap is uniform across the seam and is formed by cutting both ends of the belt material at an appropriate angle and positioning the ends so that one end may overlie the other end which then are ultrasonically welded together.

Alternative, acceptable seaming technologies can be employed such as an adhesively jointed butt and lap joints. The web can range in thickness 0.003"–0.007" with a preferred thickness of 0.004" . The seam is finished or made smooth by grinding or polishing to reduce the step height at the seam. The entirety of the belt may be ground if necessary to a surface roughness of <100$\mu$ inches and more preferably <30$\mu$ inches. Preferably, a step height of the seam after grinding of the belt to a surface roughness of <30$\mu$ inches causes the step height "h" of the seam to be reduced to 10 microns or less. While this step height represents a discontinuity in the smoothness of the belt, it is still sufficiently small to be suited to the uses described herein. The grinding of each surface of the belt at the seam areas also facilitates cleaning of the belt by each of the blade cleaners 560, 562. Other known belt cleaner devices, such as brushes, may also be used to clean the belt. The reduced step height minimizes accumulation of toner that tends to collect at discontinuities and thereby minimizes transfer artifacts.

Figure 4:
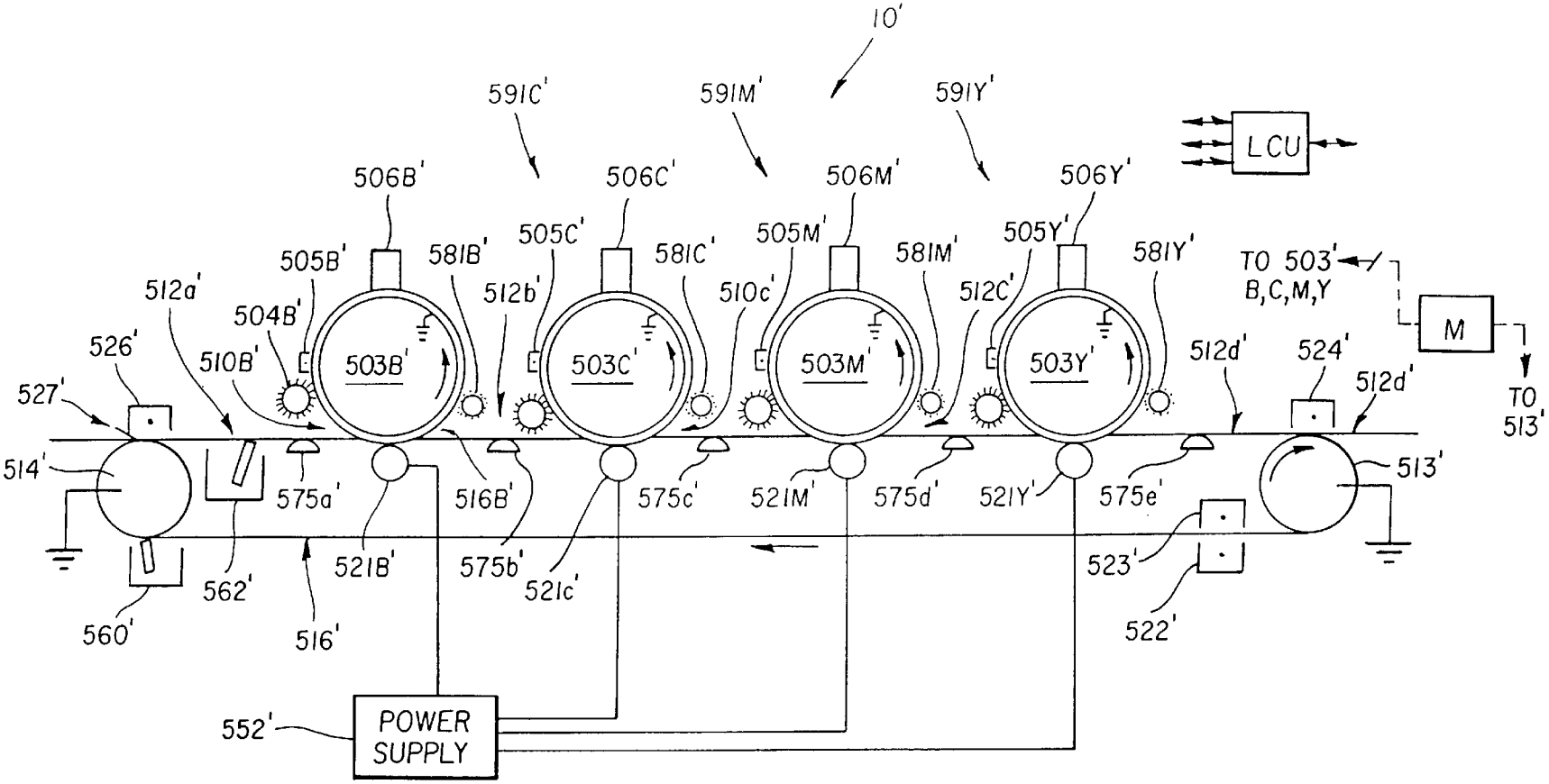
FIG. 4 is a generally schematic side elevational view of a second embodiment of a reproduction apparatus according to the invention.

With reference to FIG. 4, structures shown therein that are similar to structure in FIG. 1 are identified with a prime (') after the reference numbers. In the embodiment of FIG. 4 a toner color separation image of one of each of four colors is formed by each module 591 B', 591C', 591M', and 591Y', on respective photoconductive drums 503B', 503C', 503M', and 503Y'. The respective toned color separation images are transferred in registered relationship to a receiver member as the receiver member serially travels or advances from module to module receiving in transfer at each transfer nip (510B' is the only nip designated) a respective toner color separation image. In the embodiment of FIG. 4, the ITMs are not present and direct transfer of each image is made from the photoconductive drums to the receiver sheet as the receiver sheet serially advances through the transfer stations while supported by the paper support web 516'. The web 516' is an endless belt with a seam and is similarly configured to that illustrated in FIGS. 2 and 3. In both the embodiments of FIGS. 1 and 4, different receiver sheets may be located in different nips simultaneously and at a times one receiver sheet may be located in two adjacent nips simultaneously, it being appreciated that the timing of image creation and respective transfers to the receiver sheet is such that proper transfer of images are made so that respective images are transferred in register and as expected.

In the transfer operation of the FIGS. 1 and 4 embodiments, no control is provided relative to inhibiting or precluding feeding of a receiver member onto the seamed portion of the belt. Even though the seam is present on only one segment of the belt it still represents a functional part of the belt upon which a receiver member from time to time is supported during operation of the apparatus for receiving transfer of toner images from the ITMs (FIG. 1) embodiment or the PIFM (FIG. 4 embodiment) and broadly from a TIBM. Although a drum PIFM is preferred, the PIFM may be a belt.

Figure 5:
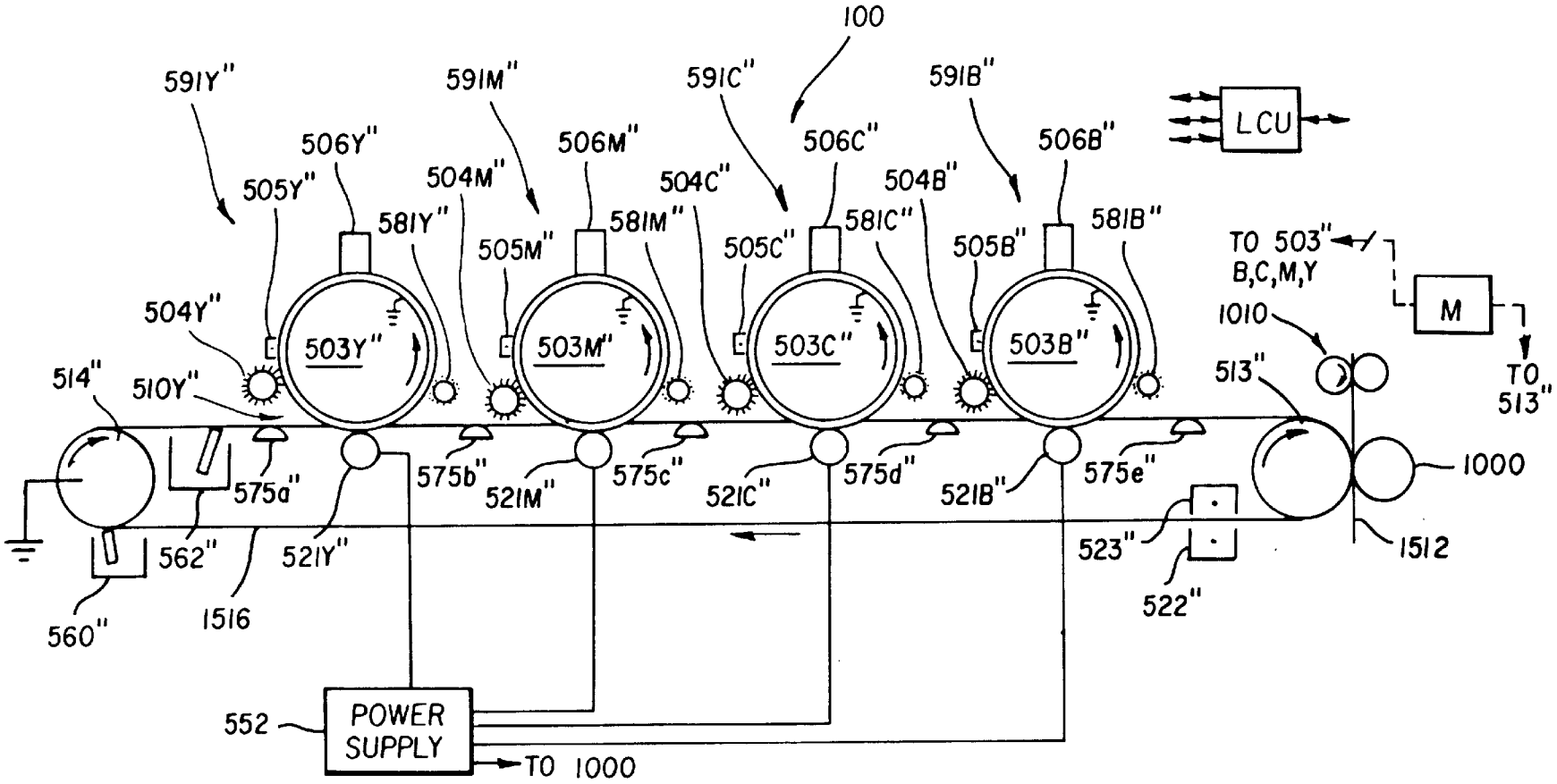
FIG. 5 is a generally schematic side elevational view of a third embodiment of a reproduction apparatus according to the invention.

With reference to FIG. 5, structures shown therein that are similar to that described with reference to FIG. 1 are identified with a double prime (") after the reference numbers. In this apparatus 100 of this embodiment the ITM is in the form of a belt 1516 and respective toner color separation images are formed by each of the color modules 591B", 591C", 591M" and 591Y", on respective photoconductive members 503B", 503C", 503M", and 503Y" and transferred to the ITM 1516. In one embodiment ITM 1516 has the various respective color images transferred to it in registration so that for a four color image-forming process, all four images are formed on the same image frame or location on the ITM belt 1516 as a composite image and then transferred in one pass between roller 513 and transfer roller 1000 to receiver sheet or member 1512 by the receiver member being driven through the transfer nip by feed rollers 1010 and movement of the ITM belt.

In a second embodiment of FIG. 5, the receiver sheet may be supported upon a transfer support drum for multiple rotation so that a series of color separation images formed on ITM 1516 in spaced relationship are transferred serially to the receiver sheet so that in four rotations of the transfer support drum a composite color toner image is first formed with proper registration on the receiver sheet. In each of the described embodiment of FIG. 5 the seamed portion of the ITM belt has a configuration as illustrated in FIGS. 2 and 3. Belts used for ITMs are well known and ITM belt 1516 may have the electrical characteristics for such known belts. In employing the ITM belt 1516, at times images will be transferred to it by the respective PIFMs so that an image may be present on the seamed area before transfer to a receiver sheet. In transfer of images to or from the ITM, suitable electrical biasing is provided at each transfer nip to establish an electric field to force movement of the charged toner particles to transfer to the ITM or from the ITM to the receiver member. Thus, in these embodiments of FIG. 5, no control need be provided relative to inhibiting or precluding transfer of a toner image onto the ITM at the seam area of the belt as the seam area represents a functional part of the belt for supporting a toner image at that area.

In the color reproduction apparatus described herein, the apparatus may also be used to form single color images or color images in various combinations of color in addition to the four-color image described. Fewer color modules may be provided in the apparatus or additional color modules may be provided in the apparatus.

In the described embodiments, the wrap of the belt that supports the receiver member in contact with the TIBM is defined by tension in the transport belt. The actual transfer nip where the major portion of the electrical field exists between the TIBM and the pressure roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transport belt is substantially insulative. As noted above, it is preferred to have the wrap be greater than 1 mm beyond the roller nip in at least the pre-nip area. Where a pressure roller is used to apply the pressure to the underside of the belt to urge the receiver member into intimate contact with the TIBM at the nip, it is preferred that the pressure roller be of intermediate conductivity, i.e. resistivity of $10^7$–$10^{11}$ ohm-cm, however, pressure rollers that are highly conductive; i.e., having conductivity of a metal, also may be used. Other structures, as noted above, in lieu of pressure rollers may be used to apply pressure to the web at the nip including members having conductive fibers that are electrically biased and provided with stiffener structure on either side of the brush for applying pressure to the web, or rollers with conductive fibers.

In the embodiments described above, transfer of the image to the ITM and from the ITM to the receiver member and generally all image transfers are made electrostatically and preferably without addition of heat that would cause the toner to soften. Thus, preferably no fusing occurs upon transfer of the toner images to the receiver member in the nips through which the paper transport belt and receiver member passes. In the forming of plural color images in registration on a receiver sheet, the invention contemplates that plural color toner images may be formed on the same image frame of the photoconductive image member using well known techniques; see, for example Gundlach, U.S. Pat. No. 4,078,929. The primary imaging member may form images by using photoconductive elements as described or dielectric elements using electrographic recording. The toners used for development are preferably dry toners that are preferably nonmagnetic and the development stations are known as two-component development stations. Single component developers may be used, but are not preferred. While not preferred, liquid toners may also be used.

Other charging means such as rollers may be used instead of the corona wire chargers used for electrostatically holding the receiver member or print media to the web and for electrically discharging the receiver member.

In the color embodiments described herein, it is preferred to use dry, insulative toner particles having a mean volume weighted diameter of between about 2 $\mu$m and about 9 $\mu$m. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass.

Figure 6:
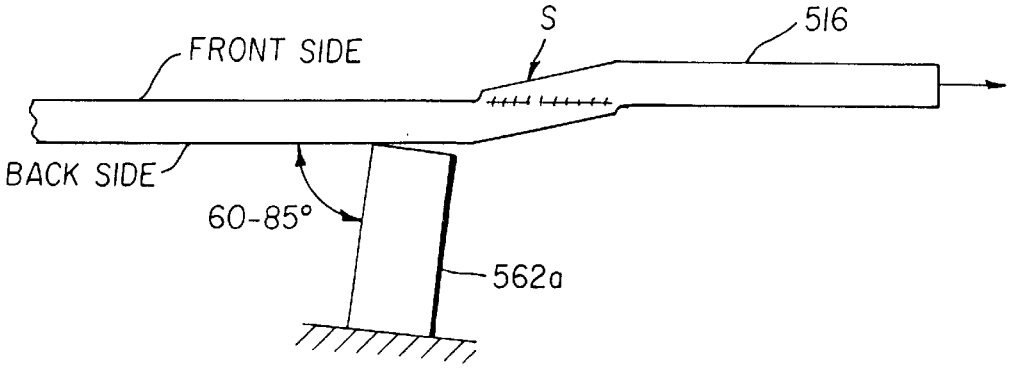
FIGS. 6, 7, 8 and 9 illustrate an elevational view in cross-section of the seam and showing various alternative backside cleaning devices.

With reference to FIGS. 3 and 6, cleaning of the front side and back side of the belt is provided by wiper blades 560*a* and 562*a* respectively. It is preferred to use wiper blades for both of the front and backside cleaning. The blades may extend for the full width of the belt; however, it is preferred that the blades extend in general about 12 mm to about 25 mm beyond each of the edges of the widest paper size, but within the belt width and may be almost the belt width. It is preferred to have the angle of the wiper blade with the belt 516 be 60°–85°, as shown. The blade is supported as a cantilever as shown and applies a normal load from 5–50 g/cm. The wiper blade may be a polyurethane with a hardness within 55–85 shore A, a rebound resiliency above 30%, a compression set below 30%.

It is preferred that for frontside cleaning of the belt that the blade edge steps down on the belt as the splice passes by to minimize the impact of the splice step on the blade stability and cleaning. Since the blade on the frontside of the belt will step down while the splice travels past the blade, the blade on the backside of the belt will have to step up against the splice as the splice passes by.

Figure 7:
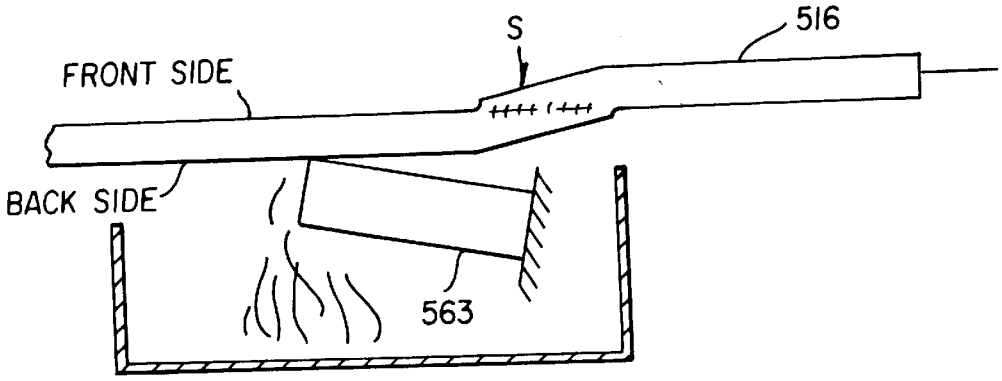

In FIG. 7, a scraper blade 563 is illustrated for cleaning the backside as an alternative cleaner. However, this is less preferred due to stability problems that may occur with the blade as it passes the splice. Stability problems due to the splice step affecting the cleaner and the problem of toner contamination collected at discontinuities within the splice step which can affect electric field for transfer can be minimized by making the splice smooth by a grinding operation as described above to reduce the step height or the level of discontinuity at the splice.

By making the splice at an angle across the length of the belt and by reducing the splice step height there will be less toner contamination at the splice and the contamination that might be transferred to the backside of the prints will be less objectionable to an observer by being at an angle other than a straight line perpendicular to the direction of movement of the belt.

Figure 8:
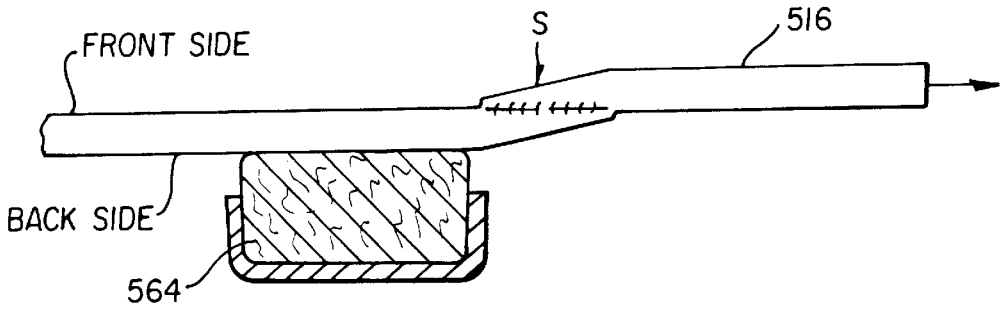
Figure 9:
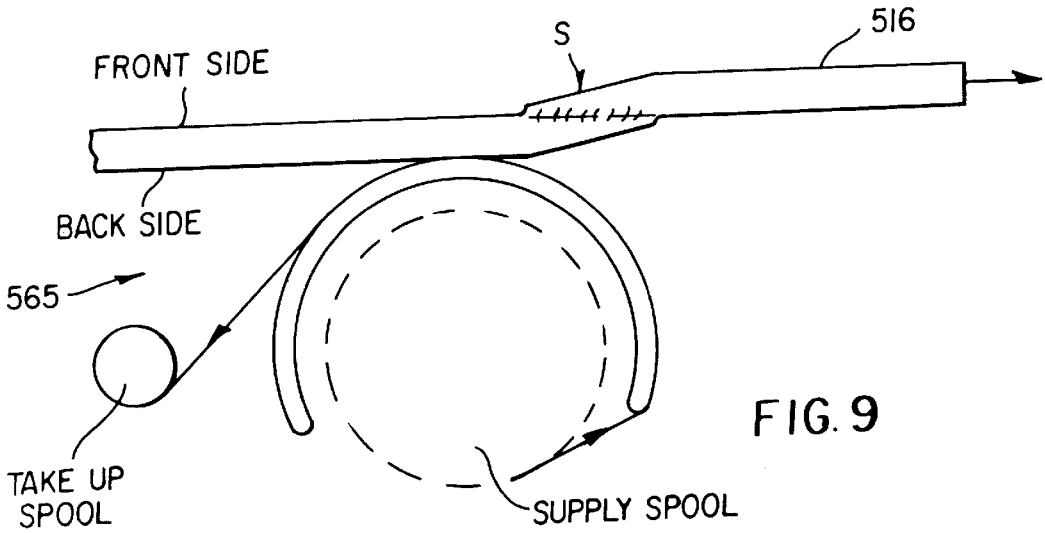

Other types of cleaning elements may be used such as fiber brushes, magnetic brushes, pads 564 (see FIG. 8) or indexing fabric cleaners 565 (FIG. 9).

A backside cleaning device that also may be used is described in Ziegelmuller et al, U.S. Pat. No. 5,655,205.

The invention has been described in detail with particular reference to presently preferred embodiments, but it will be understood that variations and modifications can be effected within the spirit and scope of the invention.

Parts List

10, 10', 100—apparatus
503, 503', 503" B—Y—photoconductive drums
504, 504', 504" B—Y—cleaner devices
505, 505', 505" B—Y—primary chargers
506, 506', 506" B—Y—image exposure devices
508 B—Y—ITMs
510, 510' B—Y—transfer nips
512, 512' *a*—*d*—receiver members or sheets
513, 514, 513', 514', 513", 514"—rollers
516, 516'—receiver member transport belt
521, 521', 521" B—Y—pressure rollers
522, 523, 522', 523'; 522", 523"—chargers
524, 524'—detack charger
526, 526'—charger
527, 527'—blade
541 B—Y—conductive cores
543 B—Y—compliant blanket layer
560, 562; 560', 562', 560", 562"—cleaner devices
560*a*, 562*a*; 560*a'*, 562*a '*, 560*a"*, 562*a"*—cleaning blades
563—scraper blade
564—pad cleaner
565—fabric cleaner

575, 575', 575"*a—e*—support members
581, 581', 581" B—Y—development stations
1000—transfer roller
1010—feed rollers
1512—receiver member or sheet
1516—ITM

We claim:

1. A reproduction method comprising:

moving a toner image bearing member (TIBM) having a toner image formed thereon in a process direction through a transfer nip, the toner image being present in the nip for transfer;

moving a belt in the process direction while supported in the nip in transfer relation with the TIBM, the belt having a seam that is configured in a configuration other than a straight line perpendicular to the process direction, the seam being present in the nip; and transferring the toner image from the TIBM towards an area of the belt having the seam as the belt and TIBM move through the nip wherein the belt supports a receiver member in the nip and the receiver member is supported on the area of the belt having the same and the receiver member receives the toner image in transfer from the TIBM.

2. The method of claim 1 wherein the seam is formed at an angle of about 20° to about 60° relative to the process direction of the belt.

3. The method of claim 1 wherein the seam is formed at an angle of about 45° relative to the process direction of the belt.

4. The method of claim 1 wherein the seam has an overlap range of 1/16 of an inch to 1/4 of an inch.

5. The method of claim 1 wherein the seam is an ultrasonically welded lap joint and the belt is between 50 $\mu$m and 200 $\mu$m in thickness and a first surface of the belt supports a receiver member in the nip and the first surface is ground to a surface roughness <100$\mu$ inches.

6. The method of claim 5 wherein the belt includes a second surface facing oppositely from that of the first surface and the second surface has a seam and the second surface is ground to a surface roughness of <100$\mu$ inches and a respective cleaning device engages each of the first and second surfaces of the belt to clean the belt.

7. The method of claim 1 wherein the seam is an ultrasonically welded lap joint and the belt is between 50 $\mu$m and 200 $\mu$m in thickness and a surface of the belt that supports a receiver member is ground to a surface roughness <100$\mu$ inches.

8. The method of claim 7 wherein the belt includes a second surface facing oppositely from that of the first surface and the second surface has a seam and the second surface is ground to a surface roughness of <100$\mu$ inches and a respective cleaning device engages each of the first and second surfaces of the belt to clean the belt.

9. A belt for use in the method of claim 1, the belt being formed as an endless web having a lap joint seam, the belt being between 50 $\mu$m and 200 $\mu$m in thickness and a surface of the belt is ground to a surface roughness of <100$\mu$ inches, the seam being formed at an angle of about 20° to about 60° relative to a lengthwise dimension direction of the belt.

10. The method of claim 1 wherein the transfer is in the presence of an electric field.

11. The method of claim 10 wherein electrical capacitance of the belt in the area of the belt including the seam is substantially the same as the electrical capacitance in an area of the belt not including the seam.

12. A reproduction method comprising:

moving a toner image bearing member (TIBM) having a toner image formed thereon in a process direction through a transfer nip, the toner image being present in the nip for transfer;

moving a belt in the process direction while supported in the nip in transfer relation with the TIBM, the belt having a seam that is configured in a configuration other than a straight line perpendicular to the process direction, the seam being present in the nip; and transferring the toner image from the TIBM towards an area of the belt having the seam as the belt and TIBM move through the nip wherein the toner image is transferred directly to the belt at an area of the belt having the seam, and the toner image is then transferred from the belt to a receiver member.

13. The method of claim 12 wherein the seam is formed at an angle of about 20° to about 60° relative to the process direction of the belt.

14. The method of claim 12 wherein the seam is formed at an angle of about 45° relative to the process direction of the belt.

15. The method of claim 12 wherein the seam has an overlap range of 1/16 of an inch to 1/4 of an inch.

16. The method of claim 12 wherein the seam is an ultrasonically welded lap joint and a first surface of the belt includes the seam and the first surface is ground to a surface roughness of <100$\mu$ inches.

17. The method of claim 16 wherein the belt includes a second surface facing oppositely from that of the first surface and the second surface has a seam and the second surface is ground to a surface roughness of <100$\mu$ inches and a respective cleaning device engages each of the first and second surfaces of the belt to clean the belt.

18. The method of claim 12 wherein the transfer of the toner image to the belt is in the presence of an electric field.

19. The method of claim 12 wherein the transfer of the toner image to the receiver member is in the presence of an electric field.

20. The method of claim 12 wherein a step height of the seam is 10 microns or less.

21. The method of claim 19 wherein the area of the belt having the seam is on an outer surface of the belt and the outer surface of the belt including the seam and areas not including the seam are ground so that areas not including the seam have a surface roughness of <100$\mu$ inches.

22. The method of claim 12 wherein the belt has a surface ground to a surface roughness of <30$\mu$ inches and a step height of the seam is 10 microns or less.

23. A reproduction method comprising:

moving a toner image bearing member (TIBM) having a toner image formed thereon in a process direction through a transfer nip, the toner image being present in the nip for transfer;

moving a belt in the process direction while supported in the nip in transfer relation with the TIBM, the belt having a seam that is ground to substantially reduce a step in the seam, the seam being present in the nip; and transferring the toner image from the TIBM towards an area of the belt having the seam as the belt and TIBM move through the nip wherein the belt supports a receiver member in the nip and the receiver member is supported on the area of the belt having the seam and the receiver member receives the toner image in transfer from the TIBM in the presence of an electric field.

24. The method of claim 23 wherein the seam is an ultrasonically welded lap joint and the belt is between 50 $\mu$m and 200 $\mu$m in thickness.

25. The method of claim 23 wherein the belt has a surface ground to a surface roughness of <30$\mu$ inches.

26. The method of claim 25 wherein a step height of the seam is 10 microns or less.

27. The method of claim 23 wherein the area of the belt used for supporting a receiver member for transfer of a toner image is ground to a surface roughness of <100$\mu$ inches.

28. The method of claim 27 wherein the surface roughness of the portions of the belt used for transfer are ground to a surface roughness of <30$\mu$ inches.

29. The method of claim 23 wherein a cleaning blade engages the belt on an outer surface of the belt that supports the receiver member and the cleaning blade steps down from one portion of the seam to an adjacent portion of the seam as the seam moves past the blade.

30. The method of claim 29 wherein the belt includes an inner surface that faces oppositely from that of the outer surface and both surfaces of the belt have a seam and both seams are ground to reduce step heights at the seam and both surfaces of the belt are ground to a surface roughness of <100$\mu$ inches and a respective cleaning device engages each of the surfaces.

31. A belt for use in the method of claim 23, the belt being formed as an endless web having an ultrasonically welded lap joint seam, the belt being between 50 $\mu$m and 200 $\mu$m in thickness and the seam being ground to reduce a step height at the seam.

32. A reproduction method comprising:

moving a toner image bearing member (TIBM) having a toner image formed thereon in a process direction through a transfer nip, the toner image being present in the nip for transfer;

moving a belt in the process direction while supported in the nip in transfer relation with the TIBM, the belt having a seam that is ground to substantially reduce a step in the seam, the seam being present in the nip; and transferring the toner image from the TIBM towards an area of the belt having the seam as the belt and TIBM move through the nip;

wherein the toner image is transferred directly to the belt at an area of the belt having the seam, and the toner image is then transferred from the belt to a receiver member.

33. The method of claim 32 wherein electrical capacitance of the belt in the area of the belt including the seam is substantially the same as the electrical capacitance in an area of the belt not including the seam.

34. The method of claim 33 wherein the belt has a surface ground to a surface roughness of <30$\mu$ inches and a step height of the seam is 10 microns or less.

* * * * *